United States Patent [19]

Pankatz

[11] Patent Number: 4,937,999

[45] Date of Patent: Jul. 3, 1990

[54] PLATE MADE OF INSULATING MATERIAL, IN PARTICULAR MINERAL FIBERS

[75] Inventor: Manfred Pankatz, Geldern, Fed. Rep. of Germany

[73] Assignee: Deutsche Rockwool Mineralwoll GmbH, Gladbeck, Fed. Rep. of Germany

[21] Appl. No.: 279,444

[22] Filed: Nov. 30, 1988

Related U.S. Application Data

[60] Division of Ser. No. 052,756, Jul. 27, 1987, Pat. No. 4,879,157, which is a continuation of Ser. No. 811,301, Dec. 16, 1985, abandoned, which is a continuation of Ser. No. 481,447, Sep. 15, 1982, abandoned.

[51] Int. Cl.[5] ..... E04G 21/00

[52] U.S. Cl. ..... 52/745; 52/90; 52/404; 52/406; 52/324; 29/417; 29/445

[58] Field of Search ..... 52/745, 404, 405, 406, 52/407, 743, 320, 323, 608, 609, 325, 324, 327; 29/417, 445

[56] References Cited

U.S. PATENT DOCUMENTS

| | | | |
|---|---|---|---|
| 718,267 | 1/1903 | Maring | 52/324 X |
| 4,125,972 | 11/1978 | Pate | 52/90 X |
| 4,187,655 | 2/1980 | Anderson | 52/90 X |
| 4,658,556 | 4/1987 | Jenkins | 52/320 X |

FOREIGN PATENT DOCUMENTS

| | | | |
|---|---|---|---|
| 1197967 | 12/1985 | Canada | 52/743 |

*Primary Examiner*—David A. Scherbel
*Assistant Examiner*—Creighton Smith
*Attorney, Agent, or Firm*—Michael J. Striker

[57] ABSTRACT

An element of insulating material, particularly for heat and/or sound insulation of buildings and for mounting between supports, has a body which has been cut into a plurality of separate parts by at least one continuous beveled cut and shaped so that they are displaceable relative to one another during mounting and can be clamped between supporting elements.

2 Claims, 7 Drawing Sheets

FIG.1
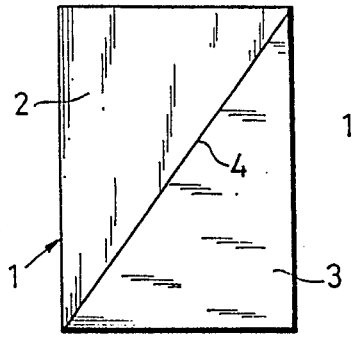
FIG.2
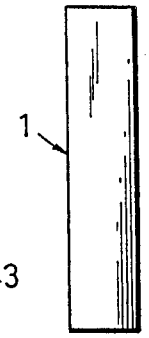
FIG.4
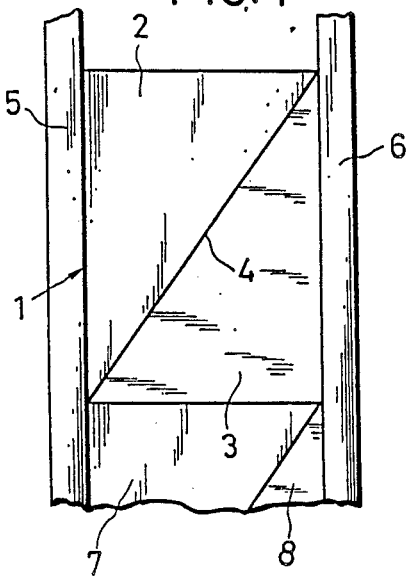
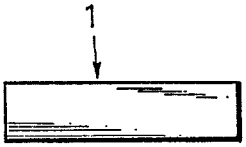
FIG.3
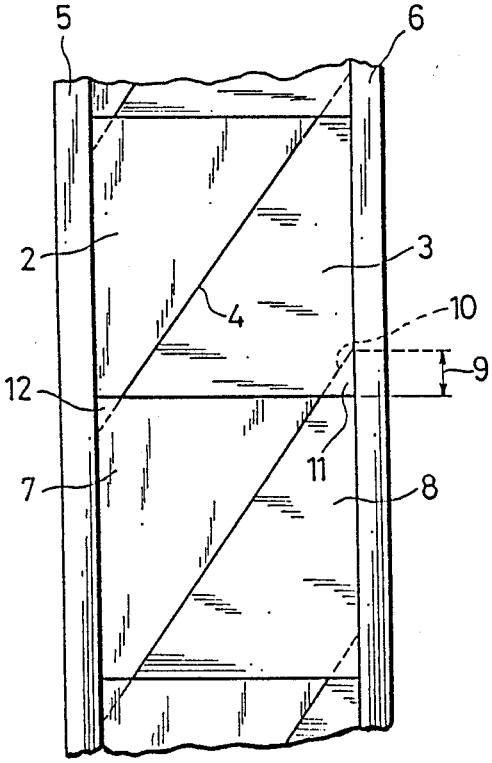
FIG.5
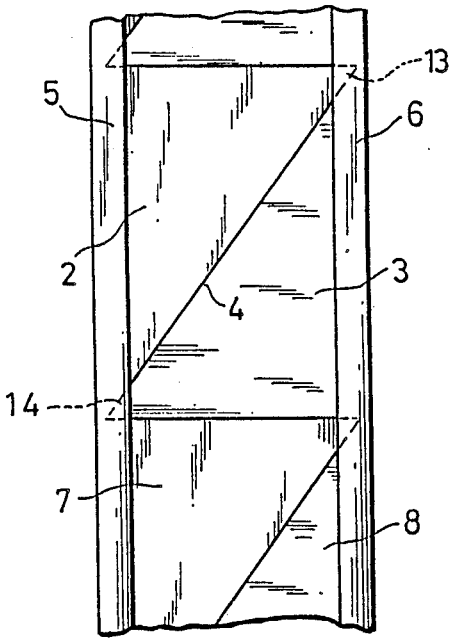
FIG.6

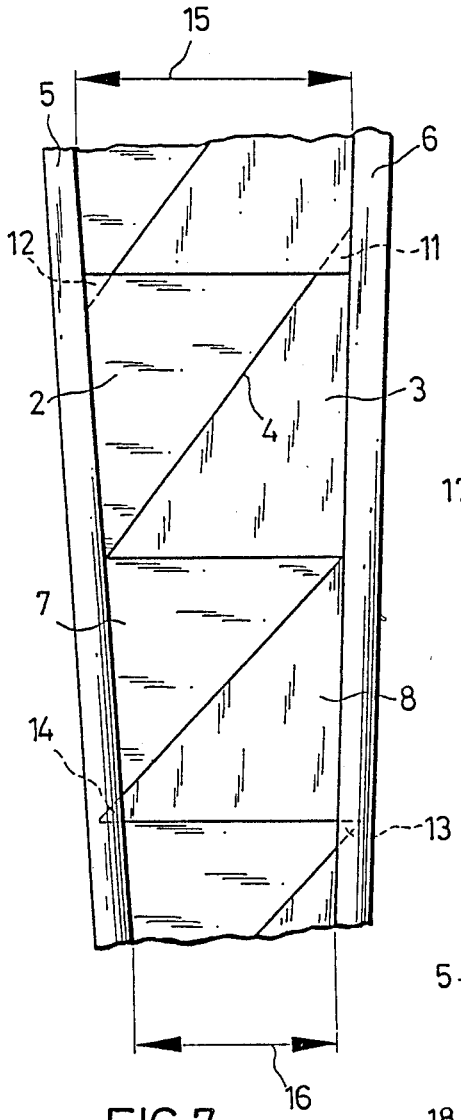
FIG.7
FIG.8
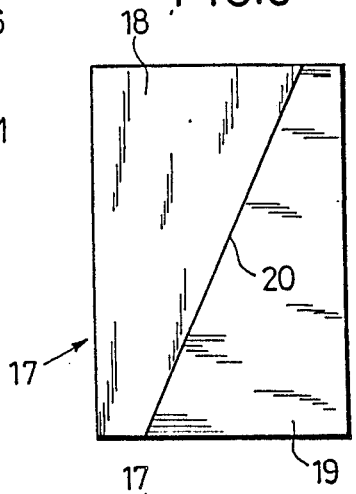
FIG.9
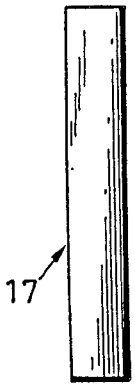
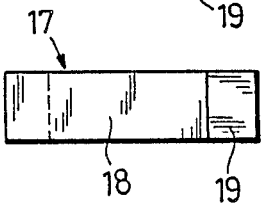
FIG.10
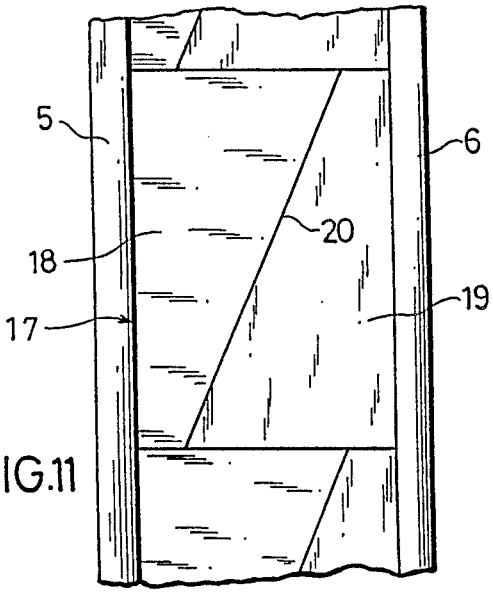
FIG.11

FIG.12
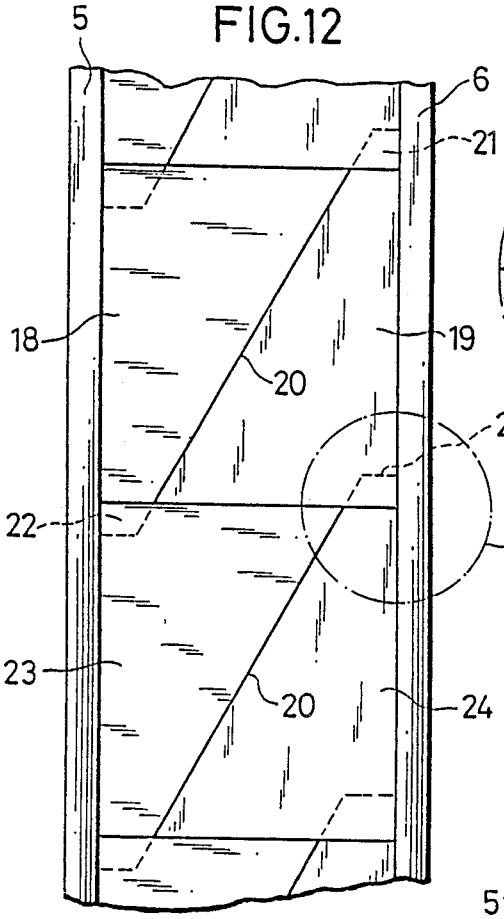
FIG.13
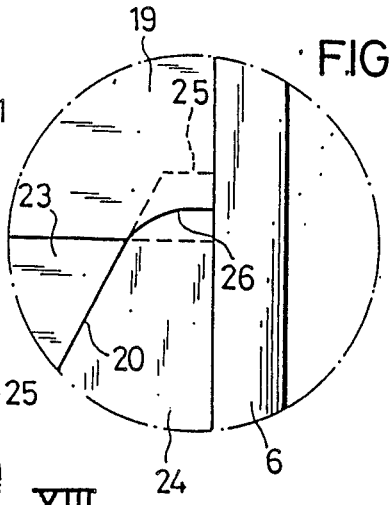
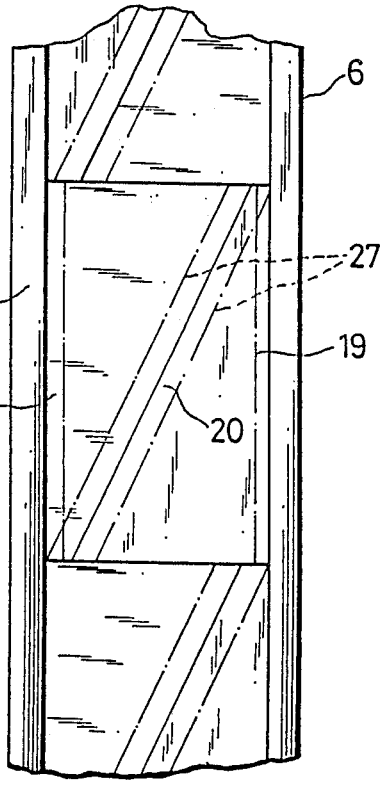
FIG.14
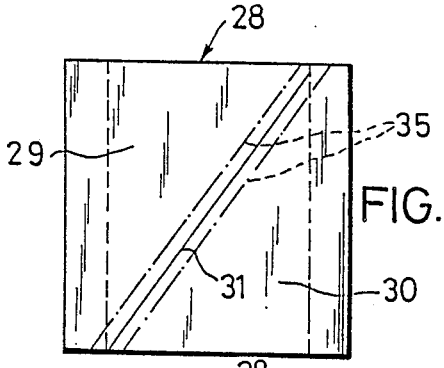
FIG.15
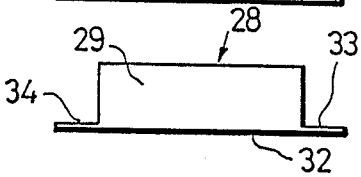
FIG.16

PLATE MADE OF INSULATING MATERIAL, IN PARTICULAR MINERAL FIBERS

This is a division of application Ser. No. 052,756, filed July 27, 1987, now U.S. Pat. No. 4,879,157, which is in turn a continuation of application Ser. No. 811,301 filed Dec. 16, 1985, abandoned which is in turn a continuation of application Ser. No. 481,447 filed on Sept. 15, 1982, abandoned.

BACKGROUND OF THE INVENTION

The invention relates to a plate made of insulating material, in particular mineral fibers which are to be used for heat and/or sound insulation of buildings and for mounting on supports, in particular for inserting between rafters. Foamed material are also taken into consideration as insulating material for the inventive use. The term plate is to be understood to be a general term i.e., the invention is also usable in other products made of mineral fibers or foamed materials which can be webs of goods or rolls.

The field of use of insulating plates for sound and/or heat insulation is very wide. Mineral fibers are preferred as insulating material and among mineral fibers stone wool is used because of its excellent characteristics. Preferably, the mineral fiber plates are used in buildings or structures or structural parts and are mounted on supports, mainly between supports, beams, rafters etc. Hitherto, the mineral fiber plates were retained "passively", i.e., they had to be mounted or anchored with special means, for example, by means of bonding. Normally, particular structures are provided for insulation in the ceiling area of buildings, whereby the mineral fiber plates are retained by gravity. Many times, the mineral plates are laminated with a foil made of aluminum or plastic whose both side edges extend over the actual mineral fiber plate and are reinforced, so that these mineral fiber plates are mounted by means of clamps, or the like, on the foil edges.

The mounting of mineral fiber insulating material or mineral fiber dampening material is connected with considerable difficulties in the practical application which has several causes. For reasons of manufacturing, mineral fiber plates are made only in certain width and marketed accordingly, that is, mineral fiber plates are mainly made in a uniform width of, for example, 62.5 cm. In contrast thereto, practice has shown that the structural supports, for example, rafters do not have a uniform width with respect to each other. For example, the free play between the individual rafters of a roof structure varies between 52 cm and 80 cm.

When using insulating material which is made from soft foam material on a plastic basis, it is possible without great difficulties to compress the soft foam material more or less and to slide it between the rafters, wherein it is retained by more or less strong clamps, because this foam material has a very low weight. However, because of the high danger for human beings and material in case of fire, the construction supervising agencies, the fire department and the insurance companies try to urge the use of insulating materials made on a basis of minerals instead of foam material on a plastic basis, due to the increasing importance of the heat dampening or insulation of buildings caused by the energy problems. However, as already explained above, one had only considerably difficult to handle mounting system at one's disposal for the use of insulating materials made on a mineral basis.

It is a conventional technology that mineral fiber plates are made in that a mass of mineral fibers is bonded into a plate by hardening of binder agents, for example, phenol resins. A mineral fiber plate made in this manner is very stiff in the transverse direction, so that it cannot be compressed by hand, at least not if the mineral fiber plate has such a thickness that it can be used for the purpose of heat insulation at all. If one would like to insert such a mineral fiber plate between rafters of different free play, it cannot be done by a simple compressing, in particular when the distance difference, as is usual, is more than 1 to 2 cm. In this case one must cut the mineral fiber plates accordingly which not only means a considerable operating and time effort, but also a loss in material. Even these adapted and cut mineral fiber plates must be retained with special mounting means.

SUMMARY OF THE INVENTION

It is an object of the invention to provide a sound and/or heat insulating dampening material plate which can be mounted easily, so that a layman is able to process without large efforts and without special tools or techniques like, for example, prior adjusting to the rafter width by means of cutting, or the like. It is a further object of the invention to equalize large width differences between structural supports. Furthermore, it is an object to retain the mineral fiber plate automatically by means of a clamping effect, if so desired. Further, it is also an object to provide a plate which can be used for a subsequent insulation of existing buildings, for example, old buildings, by insertion between the rafters, for example, without removing any roofing tiles or no more than individual rows of roofing tiles of a roof, or by insertion into hollow spaces in wall or roof constructions.

This object of the invention, based on the aforementioned plates, is obtained in accordance with the invention by providing one or a plurality of continuous bevelled cuts in such a manner that the plate parts shaped in such a manner are displaceable against each other during mounting.

Advantageous embodiments of the invention can be seen from the subclaims.

The associated wedge like plate parts which form a unit have the advantage that they can be individually inserted into a receiving space, for example, between the rafters, and they can be displaced against each other by exerting a light push or knock on them, so that they wedge themselves with respect to the supports, for example, the rafters and with respect to each other. It has been proven in practice, that with one and the same plate of a defined width large differences in the width can be bridged, for example, the clear distance between two rafters.

The advantages of the invention are essentially the following. The plates can be made on conventional production devices, which means, no investments for new installation structures in an existing factory are required, whereby mostly a certain manufacturing risk is combined therewith. In this way, the manufacturing costs can be simply calculated. Relatively large differences in the distance between the supports can be bridged, in particular between rafters. The processing with respect to the known state of the art is rather simple and can be performed by laymen, even for a subsequrnt insulation of already finished roof structures, for example, without removing all the roofing tiles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 a plan view of a plate with a diagonally extending cut,

FIG. 2 a side view of FIG. 1,

FIG. 3 a plan view with respect to FIG. 1

FIG. 4 a view of a plate in accordance with FIG. 1, which is inserted between two rafters, FIG. 5 a view in accordance with FIG. 4, whereby the distance of the rafters is larger, FIG. 6 a view in accordance with FIG. 4, whereby the distance between the rafters is smaller, FIG. 7 a view in accordance with FIG. 4, whereby the rafters extend in an oblique manner to each other, so that the distance between two rafters is different, FIG. 8 a view of a plate with bevelled cut and trapezoidal plate parts, FIG. 9 a side view with respect to FIG. 8, FIG. 10 a plan view with respect to FIG. 8, FIG. 11 a view in accordance with FIG. 8, whereby the plate is inserted between two rafters, FIG. 12 a view in accordance with FIG. 11, whereby the distance of the rafters from each other is larger, FIG. 13 an enlarged segment from FIG. 12 in accordance with the dash-dotted line XIII in FIG. 12, FIG. 14 a view in accordance with FIG. 11, whereby the rafters have a smaller distance from each other, FIG. 15 a view of another plate with a diagonal cut, FIG. 16 a plan view in accordance with FIG. 15, FIGS. 17 and 18 views of differently cut plates, FIG. 19 a partial vertical cut through the roof structure of a building, FIG. 20 a perspective view of another embodiment of a plate, FIG. 21 a front view of the plate in accordance with FIG. 20, inserted between two rafters and supported by a ceiling, and FIGS. 22 and 23 perspective views of further plate structures.

DESCRIPTION OF PREFERRED EMBODIMENTS

Figure 17:
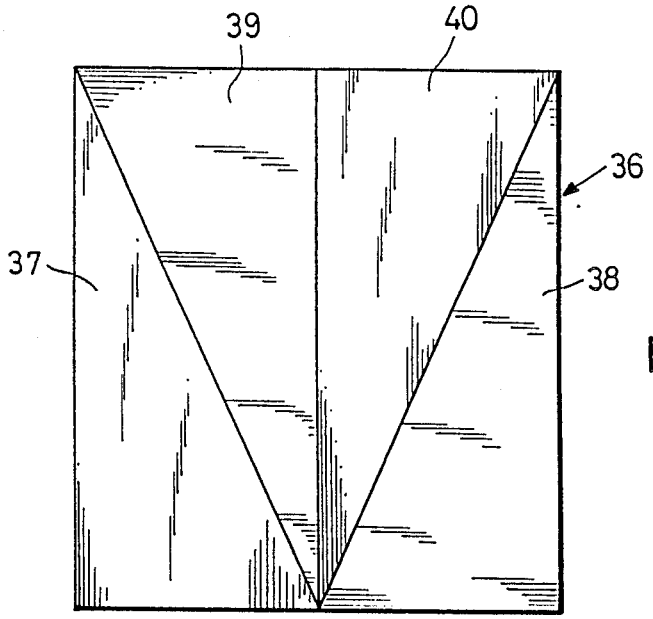

FIGS. 1 to 3 schematically show one exemplified embodiment of an inventive plate 1 which consists of two triangular plate parts 2,3, due to the diagonal cut in accordance with a cutting line 4. Therefore, these two plate parts of the plate belong to each other and form a unit. In accordance with FIG. 4, this plate 1 is inserted between two supports, in the illustrated exemplified embodiment between two rafters 5,6. In this case, the width of the plate coincides essentially with the clearance between the two rafters, so that the two plate parts are wedged in between the two rafters. In the practice, when inserting the plates, one first inserts the lower plate, so that the insertion is performed plate by plate from below upwardly. Thereby, the indicated plate part 8 is advantageously inserted between the rafters, thereafter the plate part 7 is inserted from above between the rafters and pushed downwardly until a clamping effect is obtained between the plate parts, on the one hand, and the rafters, on the other hand. Thereafter, the plate part 3 is inserted and thereafter the plate part 2.

When the distance of the rafters 5,6 in accordance with FIG. 5 is larger in the practical tolerance area than is the case in FIG. 4, the plate parts of each plates are then inserted as described with respect to FIG. 4, but they are displaced by exerting a pressure or knocking on the upper side, so that again a clamping effect is obtained. Due to the displacement triangular angled portions 11,12, illustrated in dashed lines, extend by the length 9 beyond the original dimension, but these parts are compressed in the practice and are partially absorbed by the yielding material of the adjacent plate, so that this enhances the clamping effect.

When, as is the case in FIG. 6, the rafters 5,6 have a lesser distance from each other than is the case in FIG. 4, lateral extending protruding tip portions 13,14 would result on account of the original dimension during the displacing to each other of associated plate parts 2,3 or 7,8, but they are also compressed and contribute to the improvement of the clamping effect. FIG. 7 illustrates the case wherein the rafters 5,6 extend obliquely with respect to each other, so that the clearance 15 upwardly is larger and the clearance 16 downwardly is smaller. Even then is it possible the associated plates of each unit to displace in such a manner with respect to each other, as was described with respect to FIGS. 5 and 6, so that at any rate a clamping is obtained.

FIGS. 8 to 10 illustrate another exemplified embodiment of a plate 17, wherein a cut 20 is provided extending from the upper side obliquely to the lower side, so that the plate parts 18,19 have a trapezoidal shape. In this case, the plate parts also act like wedges when pushed together and can be clamped with each other and with respect to the rafters 5,6, in accordance with FIG. 11.

FIGS. 12 and 13 again illustrate the case wherein the rafters 5,6 have a larger clear distance than in FIG. 11. Due to the displacement of the plate parts 18, 19 to each other until the clamping position, small trapezoidal like parts 21,22 extend into the material of the given adjacent plate 18,19 or 23,24. As explained at the beginning, the mineral fiber or stone wool plates cannot be compressed in the practice to such an extend that the tolerance area in the clearance between two rafters can be completely bridged, but smaller protruding parts 21,22 can be compressed without any difficulties, whereby the material of the adjacent plate yields somewhat, so that the actual engagement face does not correspond to the dashed line 25, but rather corresponds to the fully drawn out line 26.

When the clearance between the rafters 5,6, in accordance with FIG. 14 is smaller than in the case of FIG. 11, the plate parts 18,19 can also be sequentially pushed against each other from above until a good clamping effect is obtained, so that the material is compressed on both sides of the cut line 20, as illustrated in an exaggerated manner by the dash dotted lines 27, as well as in the edge area towards the two rafters. This is made possible, because the plate parts can be displaced toward each other in a wedge like manner. When the rafters have a particularly low clearance and the plate parts do not have to be displaced to each other too far, so that the base lines of the two associated plate parts have the same height, small holes may remain in front of the small front faces of the trapezoidal plate parts, under certain circumstances, which can be filled with lose mineral wool, without any difficulties.

Figure 18:
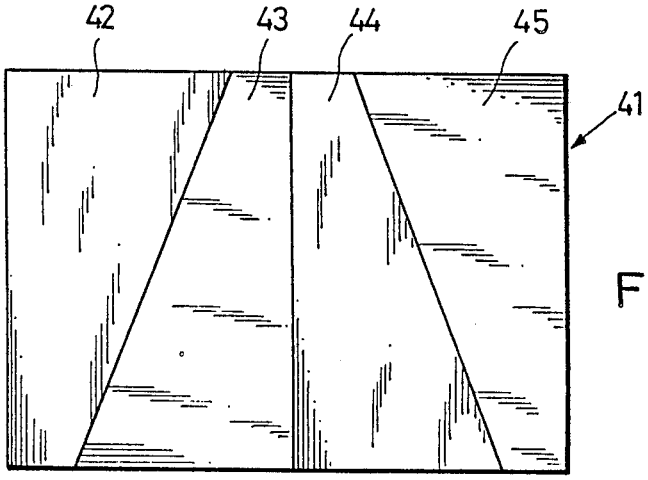

In larger width and above all for a subsequent filling of hollow spaces in building walls, which are provided with distance spacers, it can be advantageous to cut a plate 36, FIG. 17, into more than two plate parts, for example, into plate parts 37 to 40, whereby one advantageously inserts at first the plate parts 37 and 38 and subsequently the plate parts 39 and 40 into the hollow space. Another separation of a plate 41 into four trapezoidal like plate parts 42 to 45 is illustrated in FIG. 18. In this case, it is advantageous to insert at first the plate parts 43 and 44 into the hollow space and thereafter the plate parts 44 and 45 and to compress them until a retention by means of a clamping effect is obtained.

For all of the aforementioned plates, it is true that they can be encompassed with an aluminum or plastic or paper foil on one side or both sides or around the total circumference, in accordance with FIGS. 15 and 16. Circumference is understood to mean the front and rear side of the plate, as well as the side faces which engage on the supports, for example, the rafters, while the upper and lower front face of the plate remains open, in accordance with FIG. 15. In order to make the bevelled or diagonal extending cut faces more easily slideable against each other, one can laminate the two engaging faces with a corresponding foil.

In the exemplified embodiment in accordance with FIGS. 15 and 16, plate 28 is cut into two plate parts 29,30 by means of a diagonal cut line 31, whereby the cut also extends through the laminated foil 32, which is reinforced on the longitudinal edges 33,34. The plate in accordance with this exemplified embodiment is particularly suitable for insertion between rafters when the rafters are still freely accessible when the roof construction is still not completed. Although, plate 28 is self supporting between the rafters due to the clamping effect, one can mount the reinforced edge strips 33,34 by means of clamps, or the like, on the rafters. The laminated foil can be covered with an adhesive tape along the cut line, as indicated by the dash-dotted lines 35. It is also recommended to mount an adhesive tape along the horizontal joints, that is, on the places at which the individual plates engage with each other.

Figure 19:
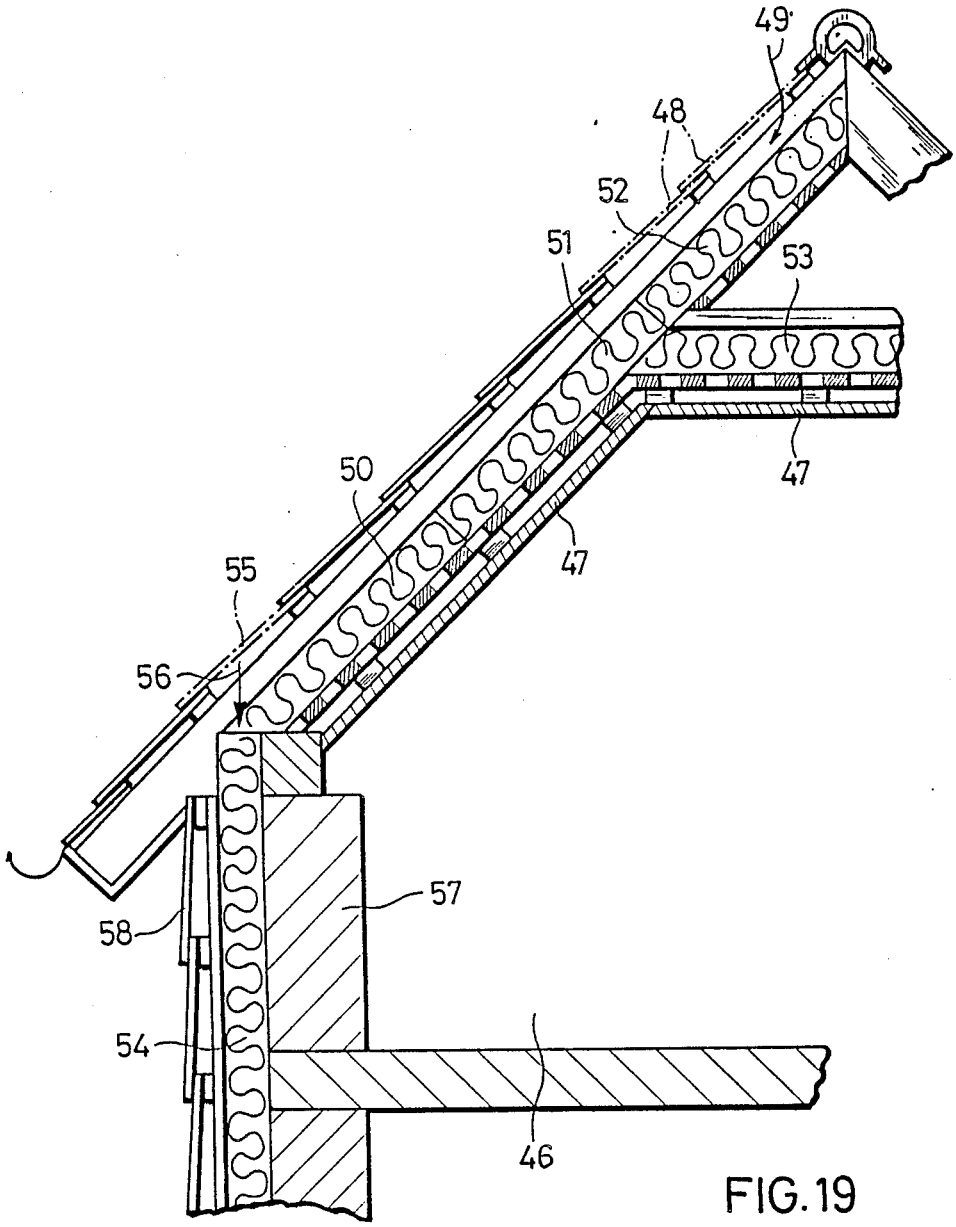

FIG. 19 illustrates especially important possibilities of use of the inventive plate. When the roof structure 46 of a building is already finished, which is indicated by the ceiling structure 47, it usually is sufficient to remove only one or eventually two rows of roof tiles 48. Thereafter, one can sequentially insert the plate parts of plates 50,51 and 52 in the direction of arrow 49, and as explained above, bring them into a clamped position by exerting pressure from above. The same holds true for the insulation with plates 53 and 54, whereby the latter can be inserted from above in direction of arrow 56 into the intermediary space between the wall parts 57 and 58, by removing a row of roof tiles 55.

In many cases, in particular during a subsequent insulating of old structures, it is also possible to enter the small triangular or otherwise designed roof space above the ceiling structure 47 in FIG. 19 and since the rafters are freely accessible to insert the inventive plates from this space into the hollow spaces above the ceiling structure 47, without removing any roof tiles.

In the aforementioned exemplified embodiments of the inventive plate in accordance with FIGS. 1 to 18, the cuts extend vertically with respect to the opposite disposed large surfaces of the plates. These plates are particularly suitable in all the cases which require a clamping effect between the supports and consequently a self support. In all of these cases, a further advantage is obtained in that the thickness of the insulation is uniform throughout.

In same cases, the use of the plates occurs at places in the building, for example, above a ceiling or casing, so that the plates are supported by the ceiling or the casing. In this case, it is not so important to use the aforementioned clamping for a self support, but the main object here is to vary the thickness of the desired insulation in accordance with the desire and the possibilities to a certain extent, which again can be accomplished by displacing the associated plates. In these latter mentioned cases, it is advantageous to dispose the cuts vertical with respect to the smaller opposing front faces.

Figure 20:
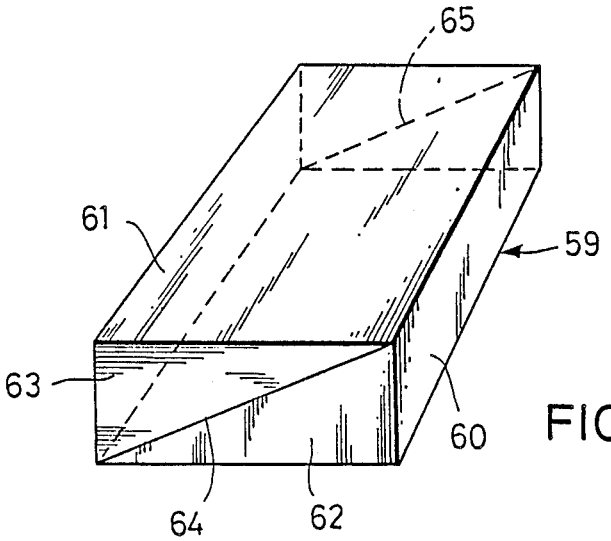

FIG. 20 illustrates such an exemplified embodiment of such a plate 59, consisting of two plate parts 60 and 61, whereby the cut in accordance with the diagonal lines 64 and 65 is so designed that they run vertically with respect to the opposite disposed small front faces, so that the front faces 62,63 have a trapezoidal shape.

Figure 21:
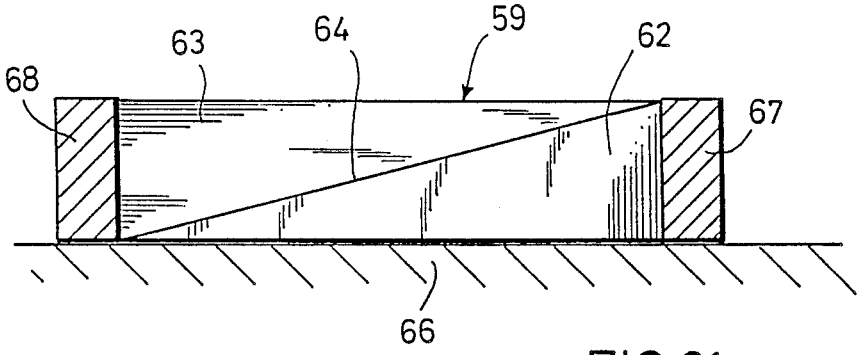

FIG. 21 shows the use of such a plate in accordance with FIG. 20 on a ceiling 66 which can extend essentially horizontal and between two vertical supports 67,68 with respect to the drawing plane, whereby these supports may consist of two wooden beams, for example. This exemplified embodiment has the essential advantage that the triangular plate parts 60,61 in the front view, can be so displaced against each other that in any case one can push them tightly onto the supports 67,68, which in this simple manner prevents the creation of any hollow spaces, slots or gaps between the insulation, on the one hand, and the ceiling, on the other hand.

Figure 22:
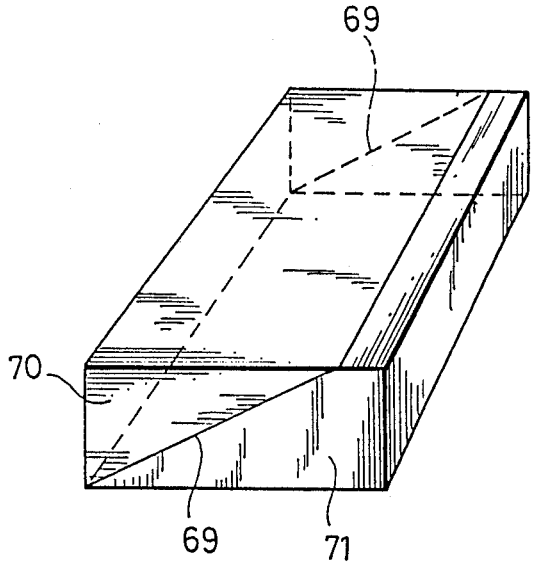

FIG. 22 is a perspective illustration of yet another exemplified embodiment of a plate, whereby the cut 69 is so disposed that one plate part 70 has a triangular shape in the front view and a further plate portion has a trapezoidal shape in the front view.

Figure 23:
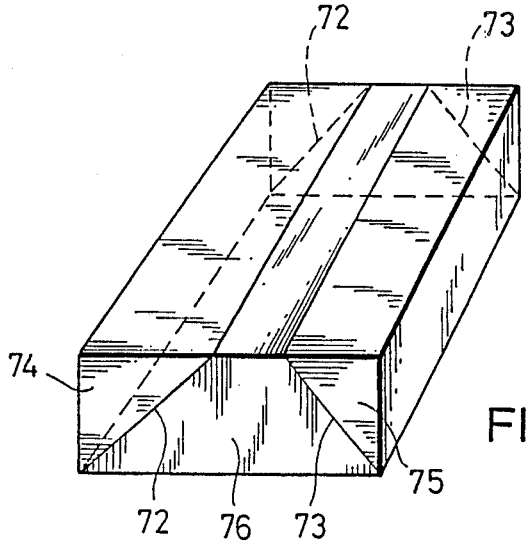

In another modification in accordance with FIG. 23, two cuts 72 and 73 are provided in such a manner that two outer plate parts 74,75 have a triangular shape in front view and the intermediary plate part 76 has a trapezoidal shape in the front view.

It is expressly stated, that depending on the case of use, one can combine the aforementioned exemplified embodiments of the plates with each other.

It will be understood that each of the elements described above, or two or more together, may also find a useful application in other types of constructions differing from the types described above.

While the invention has been illustrated and described as embodied in a plate of insulated material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of manufacturing a plate of insulating material for heat and sound insulation of buildings and for mounting in a space between supports, comprising the steps of forming a body part composed of mineral fiber insulating material and having longitudinal sides arranged to face toward the supports; subdividing the body part by at least one continuous cut which is inclined relative to said longitudinal sides into a plurality of separate parts, inserting the thusly subdivided body part loosely in one row into the space between the supports; and thereafter displacing the parts of said body relative to one another in a direction along said longitudinal sides so as to tightly abut the parts against one another and against the supports and to therefore compensate for differences in a distance between the supports.

2. A method as defined in claim 1 wherein said mineral fiber insulating material is compressible, said subdividing step including, after the insertion of the separate parts loosely in one row into the space between the supports and displacement relative to one another, producing protruding top portions, and compressing said protruding tip portions during the displacement of said separate parts relative to one another during mounting.

* * * * *